US012083408B2

(12) United States Patent
Stefan

(10) Patent No.: US 12,083,408 B2
(45) Date of Patent: Sep. 10, 2024

(54) REPLACEABLE BLADE ICE SKATE WITH CONTACT NUB

(71) Applicant: Timothy Stefan, Bozeman, MT (US)

(72) Inventor: Timothy Stefan, Bozeman, MT (US)

( * ) Notice: Subject to any disclaimer, the term of this patent is extended or adjusted under 35 U.S.C. 154(b) by 0 days.

(21) Appl. No.: 18/072,822

(22) Filed: Dec. 1, 2022

(65) Prior Publication Data

US 2024/0181325 A1 Jun. 6, 2024

(51) Int. Cl.
*A63C 1/00* (2006.01)
*A63C 1/30* (2006.01)

(52) U.S. Cl.
CPC ..... *A63C 1/303* (2013.01)

(58) Field of Classification Search
CPC ..... A63C 1/30; A63C 1/303
See application file for complete search history.

(56) References Cited

U.S. PATENT DOCUMENTS

| | | | | | |
|---|---|---|---|---|---|
| 40,921 | A * | 12/1863 | Feurstein | A63C 1/30 | 280/11.12 |
| 2,150,964 | A * | 3/1939 | Dornseif | A63C 1/30 | 280/11.18 |
| 3,947,050 | A * | 3/1976 | Isely | A63C 1/32 | 280/11.18 |
| 7,547,022 | B2 | 6/2009 | Broadbent | | |
| 7,896,363 | B2 | 3/2011 | Lovejoy | | |
| 9,855,487 | B2 | 1/2018 | Chartrand et al. | | |
| 10,894,200 | B2 | 1/2021 | Van Horne et al. | | |
| 10,974,123 | B2 | 4/2021 | Labonte et al. | | |
| 2007/0075540 | A1* | 4/2007 | Steinhauser | A63C 3/12 | 280/825 |
| 2007/0164520 | A1* | 7/2007 | Broadbent | A63C 3/08 | 280/11.18 |
| 2008/0001369 | A1* | 1/2008 | Wylie | A63C 1/32 | 280/809 |
| 2011/0148054 | A1 | 6/2011 | Davis et al. | | |
| 2014/0339802 | A1* | 11/2014 | Schoenike | A63C 3/12 | 280/825 |
| 2016/0256765 | A1* | 9/2016 | Dahlo | A63C 1/32 | |

* cited by examiner

*Primary Examiner* — Brian L Swenson
(74) *Attorney, Agent, or Firm* — Andrus Intellectual Property Law, LLP

(57) ABSTRACT

A blade holder for use with an ice skate having an removable and replaceable blade to allow the ice skate to be used during separation of the blade from the blade holder. The blade holder includes a blade-retaining base that includes a lower edge and an internal recess that receives the blade. A contact nub is mounted to the blade-retaining base and remains mounted to the base when the blade becomes separated from the base. The contact nub extends below the lower edge of the base such that when the blade becomes separated from the base, the skater can use the contact nub to contact an ice surface. The contact nub is above the blade so as not to affect the normal use of the ice skate. The contact nub can include a pick portion that is used to engage the ice surface to help move the skater when the blade becomes detached.

10 Claims, 6 Drawing Sheets

REPLACEABLE BLADE ICE SKATE WITH CONTACT NUB

BACKGROUND

The present disclosure generally relates to a blade holder for use with ice skates that have replaceable blades. More specifically, the present disclosure relates to a blade holder that includes a contact nub that allows the ice skate to be useable to move the skater upon detachment of the blade from the blade holder.

Ice hockey skates are presently designed and manufactured with a removeable blade system. The removeable blade system allows for quick and easy replacement of damaged, dull or alternate hollow and pitch (rocker) blades. Current blade holder systems use an internal hook/hinge and tightening devise located within the plastic blade holder to allow the blades to be removed and replaced as needed. An illustrative example of a removable blade system is shown and described in U.S. Pat. No. 10,974,123, the disclosure of which is incorporated herein by reference.

Although replaceable blade systems work well for the scheduled replacement of worn or broken blades, the blade holder system can malfunction during on-ice practice or competition. A blade malfunction occurs when a player's blade is unintentionally released and falls off the holder. Such malfunction can occur when a puck or stick strikes the blade with sufficient force and in a specific direction that causes the blade to completely dislodge from the holder. This malfunction leavers the player/skater with only one skate with a full blade and the other with a missing blade and only the blade holder. During such situation, the skate with the missing blade is inoperable.

When one of the blades becomes dislodged during play or practice, the plastic blade holder leaves the skate with a smooth surface and the player is unable to cut into the ice to allow for a normal skating motion. When a blade falls off the skate the player is typically initially unaware of the situation. When attempting to use the inoperable skate, the player can lose balance and may fall to the ice. Since there is no blade to assist standing up and to push off to propel the player, the player becomes a liability to the team, since they are unable get back up and participate. Typically the player is left to crawl to the bench or is helped or pushed off the ice by a team mate. Current hockey rules do not stop play for a broken or malfunctioning equipment, such as a stick or a skate. When a player has a broken skate, the team is at a disadvantage until the player can get back to the bench and be replaced by another player.

SUMMARY

The present disclosure relates to a blade holder for use as part of an ice skate that includes a removable blade system. The blade holder allows the ice skate to be useable by a skater if the blade becomes detached from the blade holder during use of the ice skate on an ice surface.

The blade holder includes a blade-retaining base that is designed and configured to be attached to the boot of the ice skate. The blade-retaining base includes a recess that is designed to receive and retain a blade such that the blade extends below a lower edge of the blade-retaining base. The blade holder further includes a contact nub that is mounted to the blade-retaining base. The contact nub remains attached to the blade-retaining base even when the blade is separated from the blade-retaining base. During normal use of the ice skate with the contact nub mounted to the blade-retaining base, the contact nub is above the ice surface and will not affect the use of the ice skate and will not affect the operation of the removable blade system.

In one contemplated exemplary embodiment of the present disclosure, the contact nub is mounted to the blade-retaining base such that at least a portion of the contact nub extends below the lower edge of the blade-retaining base but above the ice contacting skating edge of the blade. When the blade becomes separated from the blade-retaining base, at least a portion of the contact nub will be below the lower edge of the blade-retaining base. In one contemplated embodiment, a pick portion of the contact nub will extend below the lower edge such that the pick portion can be used to engage the ice surface when the blade is separated from the base.

In another contemplated embodiment, the contact nub can extend forward from a front end of the blade-retaining base. In such an embodiment, when the blade becomes separated, the contact nub can be used to engage the ice surface to help propel the skater along the ice surface. In this embodiment, the contact nub includes a pick portion that extends from the front end of the blade-retaining base.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
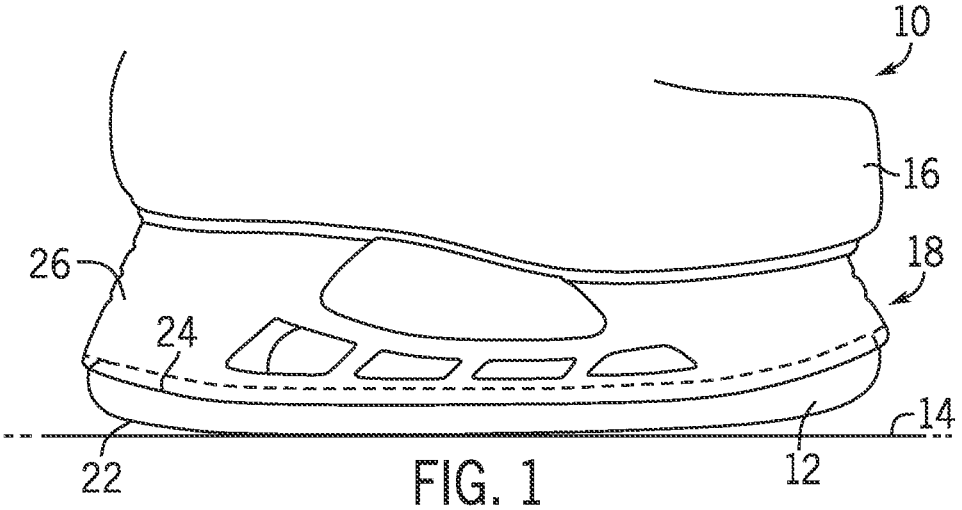
FIG. 1 PRIOR ART
FIG. 1 is a side view of a prior art hockey skate including a blade holder and a blade properly installed in the blade holder.

FIG. 1 illustrates a prior art ice skate 10 that includes a blade 12 for contacting an ice surface 14 on which a user skates. The ice skate 10 includes a skate boot 16 for enclosing a foot of the user and a blade holder 18 for holding the blade 12. In the embodiment illustrated, the ice skate 10 is a hockey skate that is designed for playing ice hockey. In other embodiments, the ice skate 10 may be designed for other types of skating activities, such as figure skating or just recreational skating.

In the embodiment illustrated, the blade 12 is designed to be lightweight yet strong and is designed to be removable from the blade holder 18. One example of such blade holder and blade is shown and described in U.S. Pat. No. 10,974, 123 that is sold under the trademark TUUK. The disclosure of this reference is incorporated herein by reference to illustrate one example of a removable blade system.

Figure 1A:
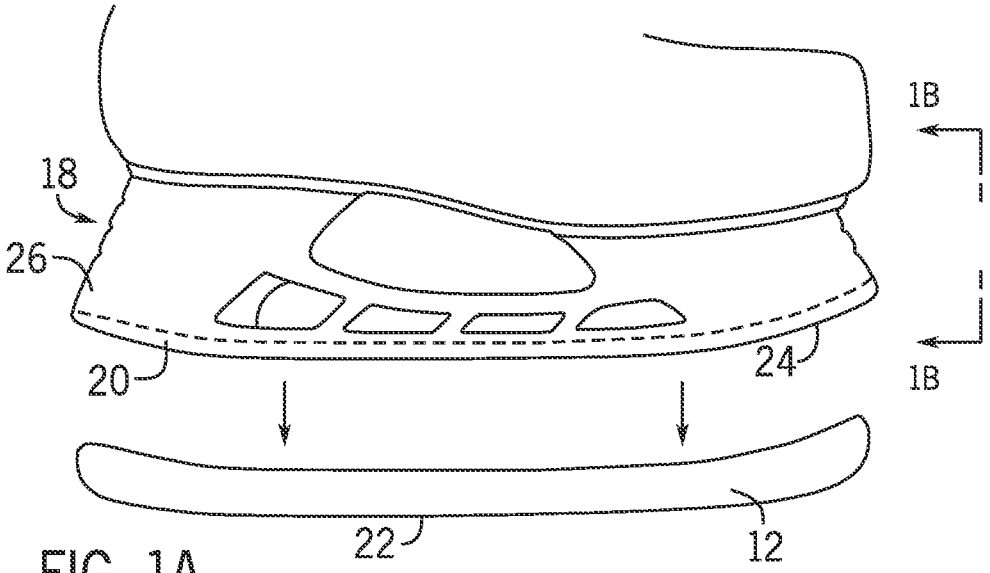
FIG. 1A PRIOR ART
FIG. 1A is a side view showing the separation of the blade from the blade holder of a prior art hockey skate.

As shown in FIG. 1A, the blade holder 18 includes an internal recess 20 that is designed to receive and retain the blade 12. Although not shown in the drawing figures, the blade 12 includes specially designed hooks or latches that engage corresponding components contained within the recess 20. In this manner, the blade 12 can be securely retained within the recess 20 of the blade holder 18 during use of the ice skate 10. The blade 12 is designed to be easily removed and replaced. The removable blade 12 allows previously sharpened blades 12 to be quickly and easily replaced in the blade holder.

Figure 1B:
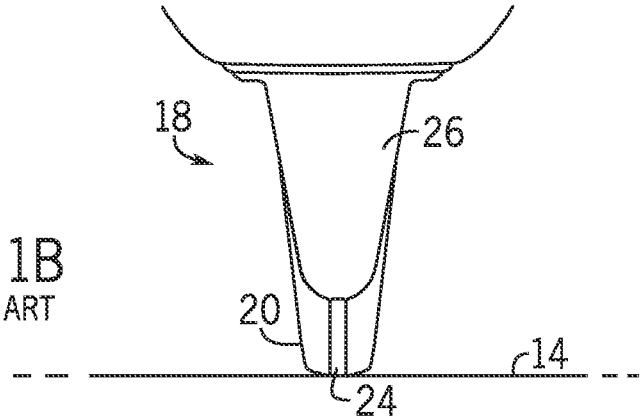
FIG. 1B PRIOR ART
FIG. 1B is a view taken along line 1B-1B of FIG. 1A showing the support of the hockey skate on an ice surface.

As illustrated in FIGS. 1 and 1A, the blade 12 includes an ice contacting skating edge 22 that extends below a lower edge 24 of the molded blade-retaining base 26. The blade-retaining base 26 is securely attached to the skate boot 16 such that the skate boot 16 and the blade retaining base 26 function as a single component. As can be seen in FIG. 1, a majority of the blade 12 extends below the lower edge 24 to support the entire ice skate on the ice surface 14 during use. When the blade 12 is removed, as shown in FIGS. 1A and 1B, the lower edge 24 is the lowermost portion of the ice skate and thus is in contact with the ice surface 14 when the blade 12 become detached from the blade holder 18. As described previously, if the blade 12 becomes detached during a time at which the user is on the ice surface, the user would be in contact with the ice surface through only the lower edge 24. Since the lower edge 24 is typically a molded plastic component, the lower edge 24 will provide nearly no traction for the user to engage the ice surface. For this reason, the subject matter of the present disclosure was recognized as being a useful improvement by the inventor.

Figure 2:
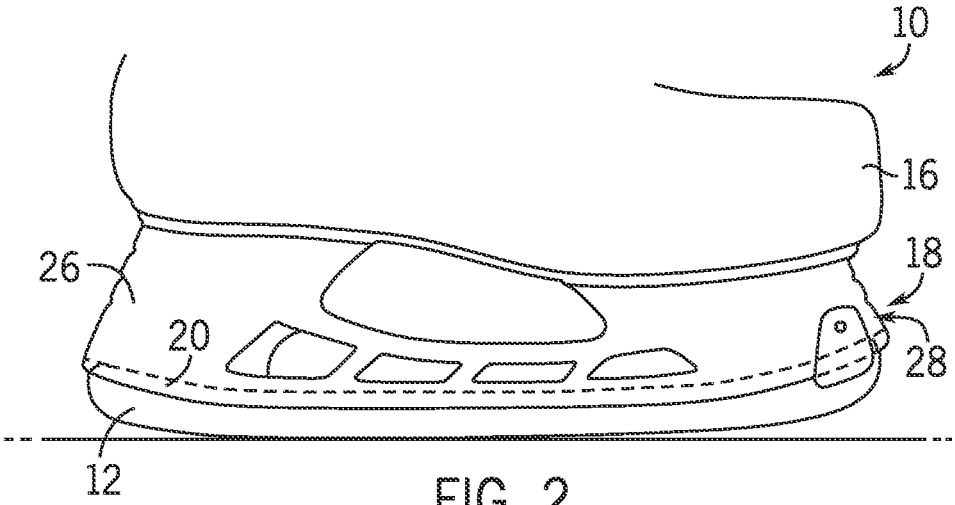
FIG. 2 is a side view of the blade holder including a first embodiment of a contact nub installed on the blade holder.
Figure 2A:
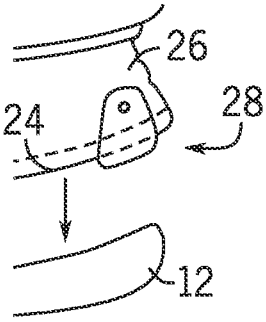
FIG. 2A is a magnified side view showing the removal of the blade from the blade holder.
Figure 2B:
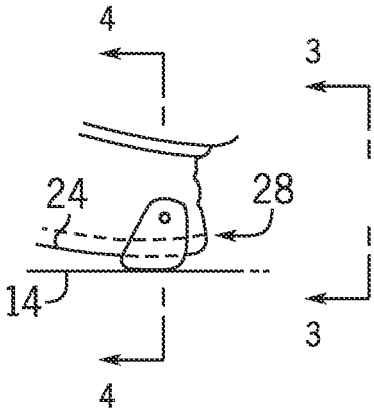
FIG. 2B is a magnified side view showing the contact between the first embodiment of the contact nub and the ice surface with the blade removed from the blade holder.

FIG. 2 illustrates a first embodiment of the present disclosure. In FIG. 2, the ice skate 10 includes a similar skate boot 16 as well as a blade holder 18 including the blade-retaining base 26 that includes a recess 20 for receiving and retaining the blade 12. In accordance with the first embodiment shown in FIG. 2, a contact nub 28 is mounted to the blade-retaining base 26 to aid in the use of the ice skate 10 should the blade 12 become detached during use on an ice surface. The contact nub 28 of the first embodiment is securely mounted to the blade-retaining base 26 and extends from the blade-retaining base such that the contact nub 28 remains mounted to the blade-retaining base 26 when the blade 12 is removed. Referring now to FIG. 2A, when the blade 12 is removed from the blade-retaining base 26, the contact nub 28 extends vertically below the lower edge 24 of the blade retaining base 26. Thus, should the blade 12 become removed, the contact nub 28 can be used by the skater to contact the ice surface 14 as shown in FIG. 2B rather than the lower edge 24. In this manner, the contact nub 28 will allow the skater to engage the ice surface 14 with the contact nub 28 rather than with the lower edge 24 of the blade-retaining base 26.

Figure 3:
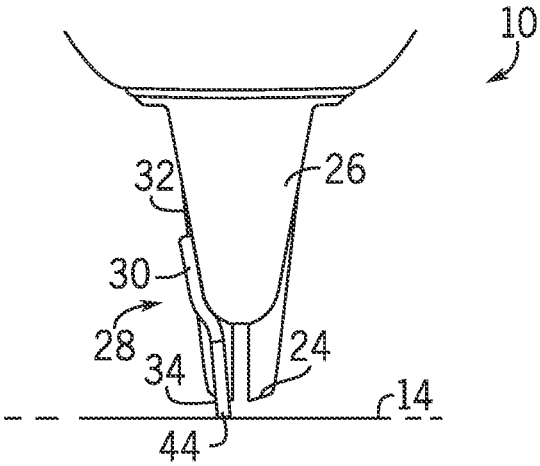
FIG. 3 is a view taken along line 3-3 of FIG. 2B showing the contact between the first embodiment of the contact nub and the ice surface.

Referring now to FIG. 3, the contact nub 28 of the first embodiment of the present disclosure comprises a plate 30 that extends between an upper end 32 and a lower end 34. The lower end 34 is designed to contact the ice surface 14 and extends below the lower edge 24 of the blade-retaining base 26. As can be seen when comparing the first embodiment of the blade holder including the contact nub 28 and the prior art embodiment of the blade holder that does not include a contact nub (FIG. 1B), the contact nub 28, and specifically the lower end 34 of the plate 30, contacts the ice surface 14 rather than having contact between the lower edge 24 and the ice surface 14 as shown in FIG. 1B. Thus, when the blade 12 is removed, as shown in FIG. 3, the ice skate 10 can be used by the skater to propel him or herself off of the ice surface.

Figure 4:
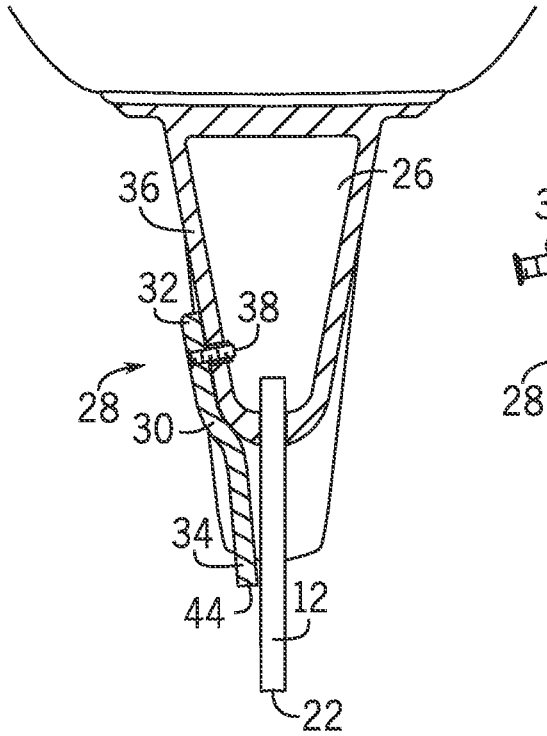
FIG. 4 is a section view showing the attachment of the first embodiment of the contact nub to the blade holder.
Figure 5:
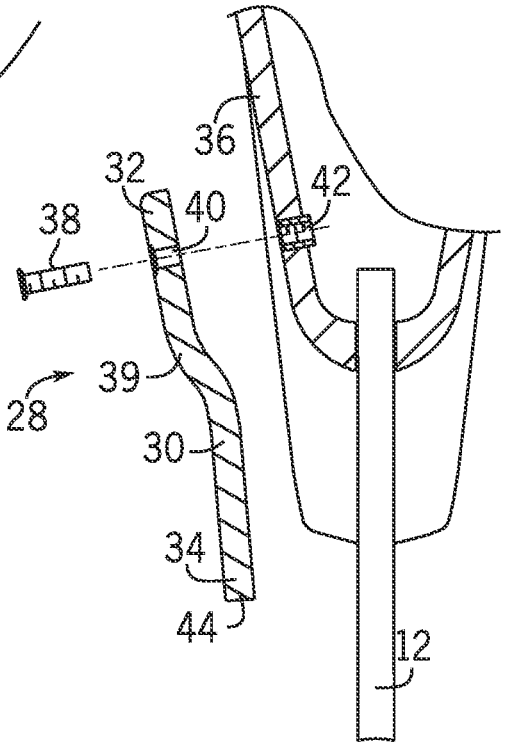
FIG. 5 is a section view showing an exploded view of the attachment of the first embodiment of the contact nub to the blade holder.

Referring now to FIG. 4, in the embodiment illustrated, the upper end 32 of the plate 30 that forms the contact nub 28 in the first embodiment is connected to a first side 36 of the blade-retaining base 26. In the embodiment shown, a connector 38 having a series of external threads is used to secure the plate 30 to the first side 36. As shown in FIG. 5, the plate 30 includes a bend 39 that somewhat corresponds to the shape of the first side 36 of the blade-retaining base 26. The plate 30 includes an attachment opening 40 located at the upper end 32. The attachment opening 40 is aligned with a threaded insert 42 that is installed in the first side 36 of the blade-retaining base 26. The threaded insert 42 includes internal threads that are designed to engage the external threads formed on the connector 38. In this manner, the connector 38 can be used to secure the plate 30 of the first embodiment of the contact nub 28 to the outer surface of the blade-retaining base 26.

As shown in FIG. 4, when the blade 12 is installed in the blade-retaining base 26, the ice-engaging edge 22 of the blade 12 is located well below the pick edge 44 that defines the lowest surface of the plate 30 near the bottom edge 24. When the plate 30 is installed as shown in FIG. 4, the inner surface of the plate 30 will be spaced slightly outward from the outer surface of the blade 12. As an example, the plate 30 could be space about 1/16 of an inch from the blade 12 such that the contact nub 28 will not affect the normal use of the removable blade system that includes the blade 12. During normal use, the contact nub 28 will have no effect on the use of the ice skate until a time when the blade 12 becomes detached from the blade-retaining base 26, such as due to contact with a puck or stick of an opposing player. When the blade 12 becomes detached, as shown in FIG. 3, the pick edge 44 can be used by the skater to engage the ice surface 14. The use of the pick edge 44 will allow the skater to use the ice skate 10 to push themselves off of the ice on the other skate that still includes a blade.

In the embodiments shown in FIGS. 2-6, the plate 30 is formed from a metallic material. However, it is contemplated that the plate 30 could be formed from other durable materials, such as nylon-reinforced plastic, plastic, carbon fiber or any other material that is both lightweight and durable enough to allow the skater to use the contact nub 28 in the manner designed.

Figure 6:
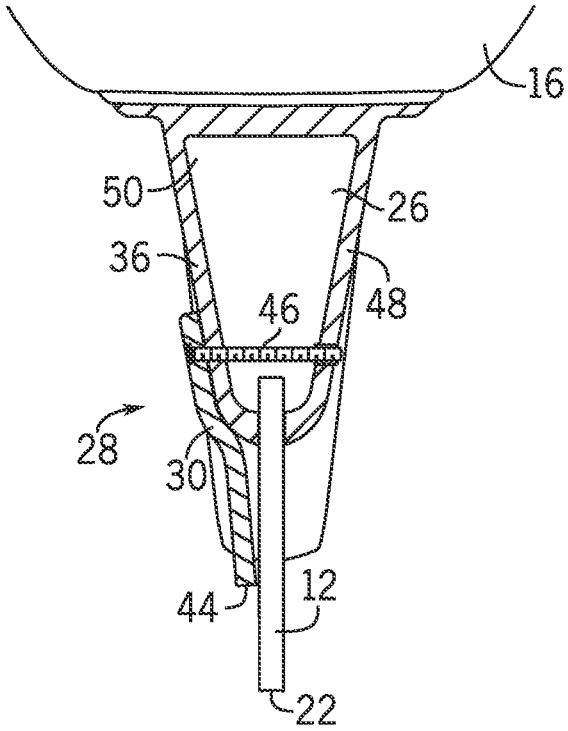
FIG. 6 is a section view showing an alternate attachment of the first embodiment of the contact nub to the blade holder.

FIG. 6 illustrates an alternate embodiment for attaching the first embodiment of the contact nub 28 to the blade-retaining base 26. In the embodiment shown in FIG. 6, a through bolt 46 is used as the connector rather than the threaded bolt shown in FIG. 5. In the embodiment shown in FIG. 6, the through bolt 46 extends through both the first side 36 and the second side 48 of the blade-retaining base 26. The through bolt 46 extends through the hollow open interior 50 and is received within threaded inserts that are installed in both of the first side 36 and the second side 48. The through bolt 46 includes external threads that are received in the threaded inserts that are installed on both sides of the blade-retaining base 26.

Figure 7:
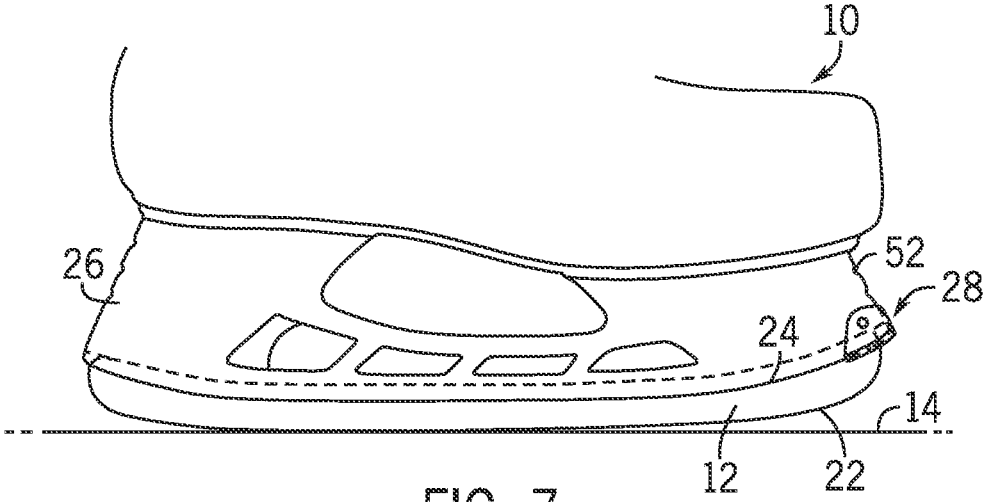
FIG. 7 is a side view of the blade holder including a second embodiment of a contact nub installed on the blade holder.
Figure 8:
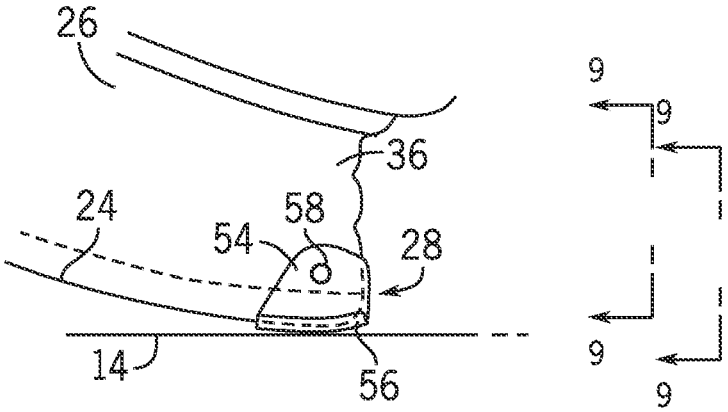
FIG. 8 is a magnified side view showing the contact between the second embodiment of the contact nub and the ice surface with the blade removed from the blade holder.
Figure 9:
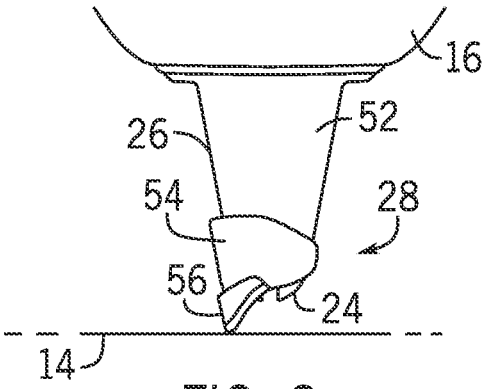
FIG. 9 is a view taken along line 9-9 of FIG. 8 showing the contact between the second embodiment of the contact nub and the ice surface.

FIGS. 7-9 illustrate a second embodiment of a contact nub 28 constructed in accordance with the present disclosure. The second embodiment of the contact nub 28 is also attached and mounted to the blade-retaining base 26. In the second embodiment, the contact nub 28 extends outward past a front end 52 of the blade-retaining base 26. As illustrated in the embodiment shown in FIG. 7, the contact nub 28 again extends below the lower edge 24 but is spaced above the ice-engaging edge 22 of the blade 12. As best shown in FIG. 9, the contact nub 28 of the second embodiment includes a sleeve portion 54 that is attached to the front end of the blade-retaining base 26. The sleeve portion 54 further includes a pick portion 56 that extends below the sleeve portion 54. The pick portion 56 is designed to extend below the lower edge 24 such that the pick portion 56 contacts the ice surface 14 when the blade becomes removed from the blade-retaining base 26. In the embodiment shown, the sleeve portion 54 and the pick portion 56 can be formed from the same or different materials. It is contemplated that the pick portion 56 would be formed from a material durable enough to engage the ice surface 14 when the blade is removed. Referring now to FIG. 8, the sleeve portion 54 is securely attached to the first side 36 by a connector 58. The connector 58 can be a threaded connector that is received within a threaded insert, in a similar manner as shown in the first embodiment illustrated best in FIG. 5. The connector 58 secures the contact nub 28 to the blade-retaining base 26 such that the contact nub 28 can be used to aid the skater engaging with the ice surface 14 when the blade 12 becomes detached, such as shown in FIGS. 8 and 9.

Figure 10:
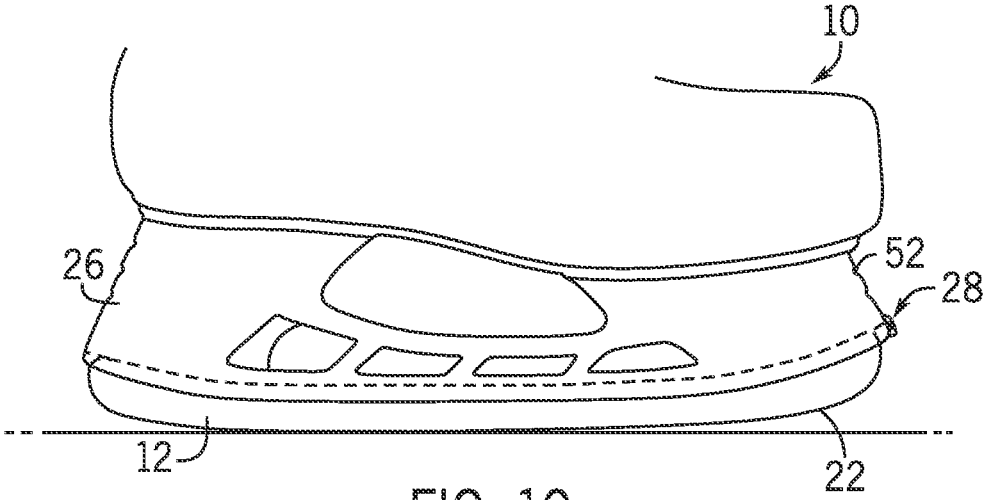
FIG. 10 is a side view of the blade holder including a third embodiment of a contact nub installed on the blade holder.
Figure 11:
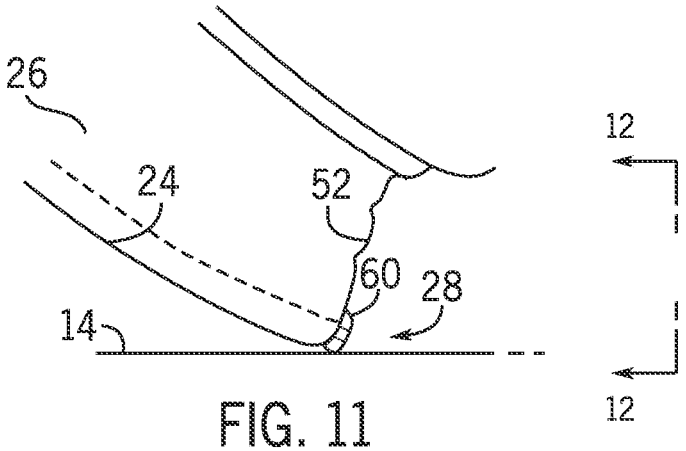
FIG. 11 is a magnified side view showing the contact between the third embodiment of the contact nub and the ice surface with the blade removed from the blade holder.
Figure 12:
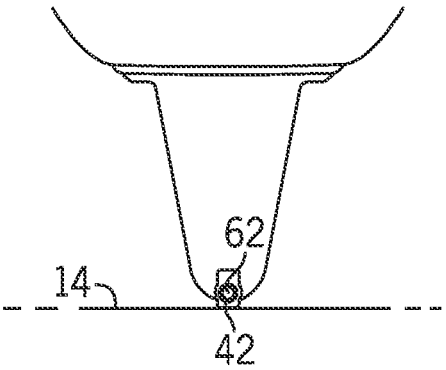
FIG. 12 is a view taken along line 12-12 of FIG. 11 showing the contact between the third embodiment of the contact nub and the ice surface.

FIGS. 10-12 illustrate a third embodiment of the contact nub constructed in accordance with the present disclosure. In the embodiment shown in FIGS. 10-12, the contact nub 28 extends from the front end 52 of the blade-retaining base 26. The contact nub 28 is again spaced above the ice-engaging edge 22 of the blade 12 when the blade 12 is received within the blade-retaining base 26, as shown in FIG. 10. Thus, as in all of the embodiments shown and described, the contact nub 28 does not affect the use of the ice skate 10 during normal use with the blade 12 installed.

When the blade 12 becomes detached, such as shown in FIGS. 11 and 12, the contact nub 28 can be used by the skater to engage the ice surface 14 to help move the skater using the other skate that includes the blade. In the embodiment shown in FIGS. 11 and 12, the contact nub 28 includes a pick portion 60 that is attached to the front end 52 using a connector 62. As in the other embodiments, the connector 62 includes external threads that are received within a threaded insert 42 that is installed in the front end 52 of the blade-retaining base 26. As can be shown in FIGS. 11 and 12, the contact nub 28 can be used to engage the ice surface 14 by utilizing the front end 52 of the blade-retaining base 26. In the embodiment illustrated, the pick portion 60 can be formed from a variety of different types of durable materials, such as metal, plastic, nylon-reinforced plastic or carbon fiber.

Figure 13:
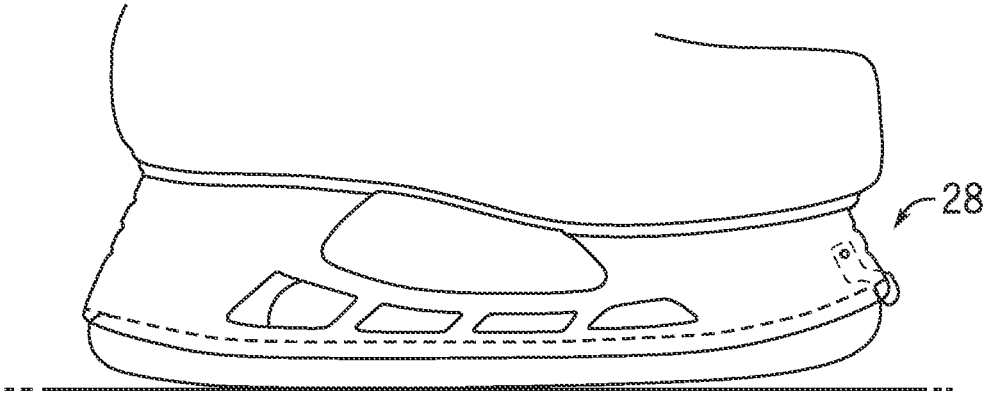
FIG. 13 is a side view of the blade holder including a fourth embodiment of a contact nub installed on the blade holder.
Figure 14A:
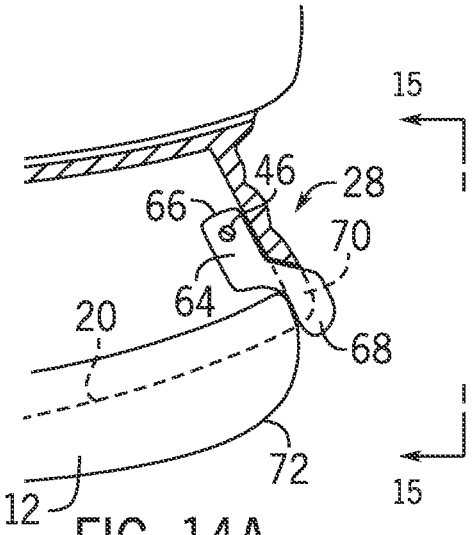
FIG. 14A is a magnified side view showing the position and location of the fourth embodiment of the contact nub on the blade holder with the blade installed'
Figure 14B:
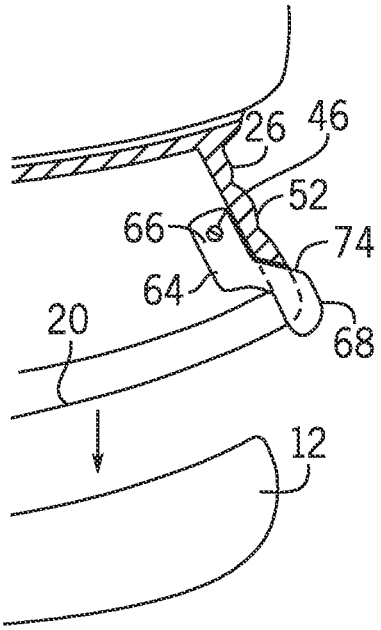
FIG. 14B is a magnified side view similar to FIG. 14A with the blade removed.
Figure 15:
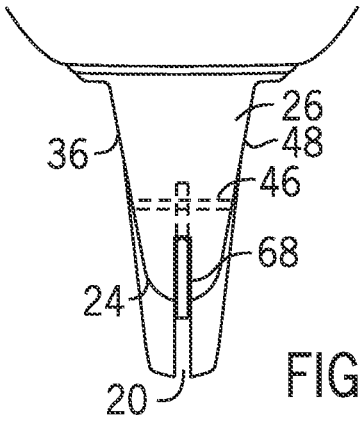
FIG. 15 is a view taken along line 15-15 of FIG. 14A showing the contact between the fourth embodiment of the contact nub and the ice surface.

FIGS. 13-15 illustrate a fourth embodiment of the contact nub 28 constructed in accordance with the present disclosure. As can be seen in FIGS. 14A and 14B, the contact nub 28 of the fourth embodiment includes a plate 64 that has an upper end 66 secured between the first side 36 and the second side 48 of the blade-retaining base 26 utilizing a through bolt 46. As in the embodiment shown in FIG. 6, the through bolt 46 is received and retained within a pair of threaded inserts that are each mounted the respective first side 36 and second side 48 of the blade-retaining base 26. In another contemplated embodiment, the through bolt 46 could be eliminated and the contact nub 28 could be otherwise inserted or cast into the blade holder during the manufacturing process.

Referring back to FIGS. 14A and 14B, the plate 64 further includes a pick portion 68 that extends through the front end 70 of the blade receiving recess 20 and thus is located past the front edge 72 of the blade 12 when the blade 12 is installed within the recess 20 as shown in FIG. 14A. Thus, during normal use, the pick portion 68 will not affect the performance of the ice skate.

When the blade 12 is removed, as shown in FIG. 14B, the pick portion 68 will extend both below the lower edge 24 and out past the front end 52 of the blade-retaining base 26. The pick portion 68 includes a contact surface 74 that contacts the front end of the recess 20 to provide support for the pick portion 68. As can be understood in FIGS. 14B and 15, when the blade 12 becomes detached, the skater can use the pick portion 68 to contact the ice surface to help propel the skater along the other skate that includes the remaining blade. In the embodiment illustrated, the plate 64 that forms the pick portion 68 can be formed from a variety of materials, such as metal, plastic, nylon-reinforced plastic or carbon fiber.

In the present disclosure, four separate embodiments are disclosed for the contact nub 28 constructed as part of the blade holder of the present disclosure. However, it should be understood that various other different configurations for the contact nub 28 are contemplated as being within the scope of the present disclosure. In each such contemplated embodiment, a portion of the contact nub must either extend below the lower edge 24 of the blade-retaining base or forward from the front end 52 such that when the blade 12 becomes disengaged, the contact nub can be used to contact the ice surface 14. It is also contemplated that the contact nub should be out of contact with the ice surface during normal use when the blade 12 is installed within the blade-retaining base of the base holder. In addition, in each embodiment, the contact nub 28 is designed and located such that the contact nub 28 does not interfere with the operation of the removable blade system. In this manner, the contact nub 28 can be used with currently available removable blade systems and not affect the normal operation of the blade replacement.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A blade holder for use with a boot of an ice skate for receiving and retaining a blade having an ice contacting skating edge, the blade holder comprising:

a blade-retaining base configured to be attached to the boot and including a first side and a second side, the blade-retaining base including an internal recess configured to receive and retain the blade such that the blade extends vertically below a lower edge of the blade-retaining base;

a contact nub mounted to the blade-retaining base and extending from the blade-retaining base, wherein the contact nub includes a pick portion that extends below the lower edge of the blade-retaining base and is located between the lower edge of the blade-retaining base and the skating edge when the blade is received and retained in the blade-retaining base, wherein the contact nub remains mounted to the blade-retaining base upon removal of the blade from the blade-retaining base.

2. The blade holder of claim 1 wherein the contact nub includes a plate attached to the blade-retaining base, the plate including an attachment portion and the pick portion.

3. The blade holder of claim 1 further comprising a connector that attaches the contact nub to at least the first side of the blade-retaining base.

4. The blade holder of claim 3 wherein the contact nub is attached only to the first side of the blade-retaining base.

5. A blade holder for use with a boot of an ice skate for receiving and retaining a blade having an ice contacting skating edge, the blade holder comprising:

a blade-retaining base configured to be attached to the boot and including a first side and a second side, the blade-retaining base including an internal recess configured to receive and retain the blade such that the blade extends vertically below a lower edge of the blade-retaining base;

a contact nub mounted to the blade-retaining base and extending from the blade-retaining base, wherein the contact nub extends from the front end of the blade-retaining base and includes a pick portion that is located above the skating edge when the blade is received and retained in the blade-retaining base.

6. A system for use with a hockey skate having blade holder including a blade-retaining base that receives and retains a blade having a skating edge that extends below a lower edge of the blade-retaining base during use, the system improving the usability of the hockey skate upon removal of the blade, the system comprising:

a contact nub configured to be mounted to the blade-retaining base such that the contact nub extends from the blade-retaining base, wherein the contact nub remains mounted to the blade-retaining base upon removal of the blade from the blade-retaining base, wherein the contact nub includes a pick portion that extends below the lower edge of the blade-retaining base and is located between the lower edge of the blade-retaining base and the skating edge when the blade is received and retained in the blade-retaining base.

7. The system of claim 6, wherein the contact nub includes a plate attached to the blade-retaining base, the plate including an attachment portion and the pick portion.

8. The system of claim 6 further comprising a connector that attaches the contact nub to at least the first side of the blade-retaining base.

9. The system of claim 8 wherein the contact nub is attached only to the first side of the blade-retaining base.

10. A system for use with a hockey skate having blade holder including a blade-retaining base that receives and retains a blade having a skating edge that extends below a lower edge of the blade-retaining base during use, the system improving the usability of the hockey skate upon removal of the blade, the system comprising:

a contact nub configured to be mounted to the blade-retaining base such that the contact nub extends from the blade-retaining base, wherein the contact nub remains mounted to the blade-retaining base upon removal of the blade from the blade-retaining base, wherein the contact nub extends from the front end of the blade-retaining base and includes a pick portion that is located above the skating edge when the blade is received and retained in the blade-retaining base.

* * * * *